US012515248B2

(12) United States Patent
Ota et al.

(10) Patent No.: US 12,515,248 B2
(45) Date of Patent: Jan. 6, 2026

(54) METHOD FOR MANUFACTURING PRESS-MOLDED ARTICLE, AND PRESS-MOLDING DEVICE

(71) Applicant: H-ONE CO., LTD., Saitama (JP)

(72) Inventors: Nobuhiro Ota, Tochigi (JP); Katsuki Takagi, Tochigi (JP); Yasuaki Teranishi, Tochigi (JP); Shuhei Watanabe, Tochigi (JP)

(73) Assignee: H-ONE CO., LTD., Saitama (JP)

( * ) Notice: Subject to any disclaimer, the term of this patent is extended or adjusted under 35 U.S.C. 154(b) by 377 days.

(21) Appl. No.: 18/042,935

(22) PCT Filed: Aug. 27, 2021

(86) PCT No.: PCT/JP2021/031474
§ 371 (c)(1),
(2) Date: Feb. 24, 2023

(87) PCT Pub. No.: WO2022/045285
PCT Pub. Date: Mar. 3, 2022

(65) Prior Publication Data

US 2023/0356279 A1 Nov. 9, 2023

(30) Foreign Application Priority Data

Aug. 28, 2020 (JP) ..... 2020-144292

(51) Int. Cl.
*B21D 22/26* (2006.01)
*B21D 5/01* (2006.01)
(Continued)

(52) U.S. Cl.
CPC ..... *B21D 22/26* (2013.01); *B21D 5/01* (2013.01); *B21D 22/10* (2013.01); *B21D 24/005* (2013.01); *B21D 37/08* (2013.01)

(58) Field of Classification Search
CPC ..... B21D 22/20; B21D 22/22; B21D 22/10; B21D 24/005; B21D 22/26; B21D 37/08
See application file for complete search history.

(56) References Cited

U.S. PATENT DOCUMENTS

2014/0356643 A1 12/2014 Nakata et al.
2016/0067757 A1* 3/2016 Flehmig ..... B21D 39/00 72/349
(Continued)

FOREIGN PATENT DOCUMENTS

JP 2002-172423 A 6/2002
JP 2006-289480 A 10/2006
(Continued)

OTHER PUBLICATIONS

International Search Report corresponding to Application No. PCT/JP2021/031474, dated Nov. 16, 2021, 2 pages.
(Continued)

*Primary Examiner* — Debra M Sullivan
(74) *Attorney, Agent, or Firm* — Rankin, Hill & Clark LLP

(57) ABSTRACT

The invention is a press-molding device which is configured to obtain a press-molded article with a hat-shaped cross section by compressing a preform with a hat-shaped cross section between a punch of a first mold and a die of a second mold. The press-molding device includes: a punch and a die forming a compression mechanism to compress a flange and a side wall of a hat-shape in the preform; a compression block forming a first pressing mechanism to press an outer end portion of the flange of the hat-shape in the preform; a pad forming a second pressing mechanism to press an upper end portion of the side wall of the hat-shape in the preform.

8 Claims, 10 Drawing Sheets

(51) Int. Cl.

| | |
|---|---|
| ***B21D 22/10*** | (2006.01) |
| ***B21D 24/00*** | (2006.01) |
| ***B21D 37/08*** | (2006.01) |

(56) References Cited

U.S. PATENT DOCUMENTS

| | | | |
|---|---|---|---|
| 2016/0263637 | A1 | 9/2016 | Yoshikawa et al. |
| 2020/0023418 | A1 | 1/2020 | Miyake et al. |

FOREIGN PATENT DOCUMENTS

| | | | |
|---|---|---|---|
| JP | 2010-099700 | A | 5/2010 |
| JP | 2015-110237 | A | 6/2015 |
| JP | 2017-100183 | A | 6/2017 |
| JP | 6183468 | B2 | 8/2017 |
| JP | 6527544 | B2 | 6/2019 |
| WO | 2013/094705 | A1 | 6/2013 |

OTHER PUBLICATIONS

Japanese Office Action dated Mar. 19, 2024 issued in corresponding Japanese application No. 2020-144292; English machine translation included (9 pages).

Chinese Office Action dated Apr. 16, 2025 issued in corresponding Chinese application No. 202180052899.X; English machine translation included (16 pages).

* cited by examiner

METHOD FOR MANUFACTURING PRESS-MOLDED ARTICLE, AND PRESS-MOLDING DEVICE

TECHNICAL FIELD

The present invention relates to a method for manufacturing a press-molded article, and a press-molding device.

BACKGROUND ART

Conventionally, there has been known a method for manufacturing a press-molded article in which a blank with a square U-shaped cross section obtained by subjecting a raw plate to a bending process or the like is subjected to such a process that vertical wall portions on the open side of the square U-shape are compressed between an upper mold and a lower mold in an up-down direction with lower ends of the vertical wall portions being in contact with the lower die (for example, see Patent Literature 1).

The manufacturing method as described above prevents spring-back that acts in such a way that the vertical wall portions spread away from each other, and can improve dimensional accuracy of the obtained press-molded article.

PRIOR ART LITERATURE

Patent Literature

Patent Literature 1: JP6527544B2

SUMMARY OF THE INVENTION

Problem to be Solved by the Invention

Many of long members generally used for a vehicle body frame and the like have a closed cross section structure obtained by fitting together half bodies (half shells) with hat-shaped cross sections and welding flanges corresponding to brim portions of the hat shapes to each other. Accordingly, it is desirable to prevent the spring-back also in the method for manufacturing the press-molded article with the hat-shaped cross section as described above.

However, in the method for manufacturing the press-molded article with the hat-shaped cross section, it is necessary to prevent not only the spring-back that acts in such a way that the vertical wall portions spread away from each other but also spring-back that acts in such a way that angles formed between the vertical wall portions and the flange portions increase. Accordingly, in the conventional method for manufacturing the press-molded article (for example, see Patent Literature 1), it is impossible to sufficiently improve the dimensional accuracy of the press-molded article with the hat-shaped cross section.

An object of the present embodiment is to provide a method for manufacturing a press-molded article, and a press-molding device that enable obtaining of a press-molded article with a hat-shaped cross section in which spring-back is sufficiently reduced and which has excellent dimensional accuracy, in simple steps.

Solution to Problem

A method for manufacturing a press-molded article of the present invention that solves the aforementioned problem is characterized in that a second bent plate body with a hat-shaped cross section is obtained by a first bent plate body with a hat-shaped cross section is in-plane compressed between a first mold and a second mold, over a range from a side wall forming a crown portion of a hat shape in the first bent plate body with the hat-shaped cross section to a flange of the hat shape, along a peripheral length direction of the hat shape.

Moreover, a press-molding device of the present invention that solves the aforementioned problem is a press-molding device which obtains a second bent plate body with a hat-shaped cross section by compressing a first bent plate body with a hat-shaped cross section between a first mold and a second mold. Each of the bent plate bodies with the hat-shaped cross sections includes a side wall which is formed to correspond to a crown portion of a hat shape and which extends in a height direction of the crown portion and a flange which is formed to correspond to a brim portion of the hat shape and which extends outward from an end portion of the side wall on the open side of the crown portion to project in a direction away from the end portion. The first mold is formed of a punch and includes a first wall surface formed to correspond to a side wall of the second bent plate body with the hat-shaped cross section; and a second wall surface formed to correspond to a flange of the second bent plate body with the hat-shaped cross section. The first wall surface and the second wall surface form a first corner portion. and are continuous with each other. The second mold is formed of a die and a third wall surface parallel to the first wall surface and a fourth wall surface parallel to the second wall surface. The third wall surface and the fourth wall surface form a second corner portion and are continuous with each other. The press-molding device includes: a compression mechanism to bring the first corner portion and the second corner portion close to each other and compresses the side wall of the first bent plate body with the hat-shaped cross section between the first wall surface and the third wall surface and the flange of the first bent plate body with the hat-shaped cross section between the second wall surface and the fourth wall surface; a first pressing mechanism to press an end portion of the flange on the opposite side to the first corner portion in the first bent plate body with the hat-shaped cross section toward the first corner portion; and a second pressing mechanism to press an end portion of the side wall on the opposite side to the first corner portion in the first bent plate body with the hat-shaped cross section toward the first corner portion.

Advantageous Effect of the Invention

The present invention provides a method for manufacturing a press-molded article, and a press-molding device which obtain a press-molded article with a hat-shaped cross section in which spring-back is sufficiently reduced and which has excellent dimensional accuracy, in simple steps.

EMBODIMENT FOR CARRYING OUT THE INVENTION

Next, a method for manufacturing a press-molded article (hereinafter, simply referred to as press-molding method in some cases) in a mode for carrying out the present invention (present embodiment) and a press-molding device for carrying out this method are described in detail with reference to the drawings as appropriate.

The press-molding method of the present embodiment is a method in which, for example, a preform with a hat-shaped cross section made of a plate material such as a steel plate is in-plane compressed in a mold and a final molded article with a hat-shaped cross section is obtained.

An example of the press-molded article obtained in the present embodiment is described below, and then the press-molding device and the press-molding method are described. Note that directions of up and down in the following description are based on directions of up and down of the press-molding device. Moreover, directions of up and down in the press-molded article coincide with up and down directions of the press-molded article obtained in the press-molding device.

<Press-Molded Article>

Figure 1:
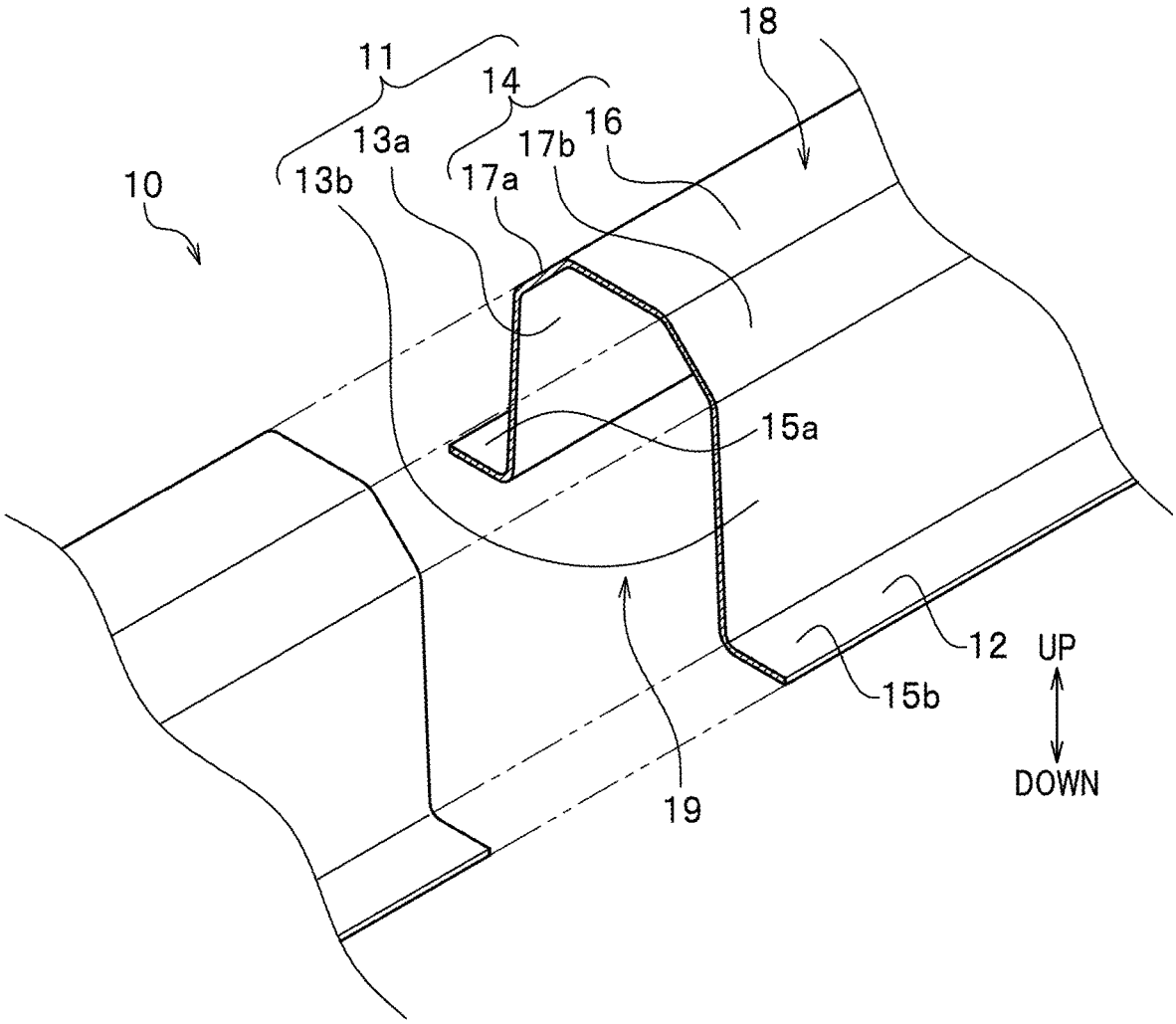
FIG. 1 is a partial perspective view illustrating an example of a press-molded article that can be obtained in a manufacturing method according to an embodiment of the present invention.

FIG. 1 is a partial enlarged perspective view illustrating an example of a press-molded article 10 that can be obtained in the press-molding method according to the present embodiment.

The press-molded article 10 in the present embodiment is assumed to be an elongated structural member made of a high-tensile strength steel plate and used in a vehicle body frame of an automobile or the like. However, the press-molded article 10 is not limited to this, and the present embodiment can be applied to structural members made of various metal materials used in various fields. Note that a portion of the press-molded article 10 in FIG. 1 is drawn to be cut out for convenience of illustration drawing a horizontal cross section.

As illustrated in FIG. 1, the press-molded article 10 is a member (long member) elongated in one direction, and a horizontal cross section intersecting a longitudinal direction has a hat shape.

The hat shape includes paired side walls 13*a* and 13*b* forming side surfaces of a crown portion 11, a top portion 14 of the crown portion 11 coupling one end sides (upper end sides) of the paired side walls 13*a* and 13*b* to each other, and paired flanges 15*a* and 15*b* forming a brim portion 12 (brim), as well known.

The crown portion 11 has a substantially square U-shape (substantially U-shape) in which the one end sides of the paired side walls 13*a* and 13*b* are closed on the top portion 14 side and the other end sides (lower end sides) of the side walls 13*a* and 13*b* are opened. The flanges 15*a* and 15*b* are formed to protrude outward (in directions away from the opening) from end edges (lower edges) of the respective paired side walls 13*a* and 13*b* on the open side of the crown portion 11 having the substantially square U-shape (substantially U-shape).

The top portion 14 of the crown portion 11 in the present embodiment is configured to include a horizontal wall 16 laid to be connected to the one ends of the paired side walls 13*a* and 13*b* via chamfered portions 17*a* and 17*b*.

Although the chamfered portions 17*a* and 17*b* forming the top portion 14 in the present embodiment are formed to be such tilted surfaces that a width between the chamfered portions 17*a* and 17*b* becomes gradually smaller as the chamfered portions 17*a* and 17*b* extend from the one ends of the paired side walls 13*a* and 13*b* toward the upper side, the chamfered portions 17*a* and 17*b* may be formed to be curved surfaces (rounded surfaces) bulging upward, instead of the tilted surfaces.

Moreover, the mode of the top portion 14 may be such that the horizontal wall 16 is connected to the one ends of the side walls 13*a* and 13*b* while forming predetermined angles therewith without the chamfered portions 17*a* and 17*b* or the curved surfaces (illustration is omitted).

Furthermore, although the press-molded article 10 of the present embodiment is assumed to have the hat-shaped horizontal cross section over the entire length in the longitudinal direction, a portion of the press-molded article 10 in the longitudinal direction may have the hat-shaped horizontal cross section. Moreover, each of the side walls 13*a* and 13*b* and the horizontal wall 16 is not limited to a wall having a flat-plate shape along the longitudinal direction, and a wall including a curved surface that is curved to warp with respect to the longitudinal direction is also acceptable. Furthermore, each of the side walls 13*a* and 13*b* and the horizontal wall 16 may be a wall including some unevenness such as a step or a bead formed in a plane direction. Moreover, a hole portion extending through the wall in a plate-thickness direction may be formed in each of the side walls 13*a* and 13*b* and the horizontal wall 16.

Furthermore, although the press-molded article 10 in the present embodiment is assumed to be an article in which one side wall 13*a* out of the paired side walls 13*a* and 13*b* has a smaller length than the other side wall 13*b* in the height direction (up-down direction) of the crown portion 11, the paired side walls 13*a* and 13*b* may have the same length.

Moreover, although the press-molded article 10 in the present embodiment is assumed to be an article in which the paired flanges 15*a* and 15*b* have the same horizontal width (length in the direction intersecting the longitudinal direction), the horizontal widths of the paired flanges 15*a* and 15*b* may vary from each other.

In the press-molded article 10 in the present embodiment, the flanges 15*a* and 15*b* are connected to another prepared member (illustration is omitted) by spot welding or the like, and a closed cross section is thereby formed between the other prepared member and an inside of the crown portion 11.

Note that examples of the other prepared member include, but not limited to, three-dimensional structures such as a floor panel of a vehicle body, a panel member forming a dashboard lower portion, and another hat-shaped member (half body) fitted and joined to the press-molded article 10 that is the other half body.

The aforementioned press-molded article 10 that is the final molded article is molded by using a press-molding device 30 (see FIG. 2) to be described later, and corresponds to a "second bent plate body with a hat-shaped cross section" described in the scope of claims.

The press-molded article 10 varies from a preform 20 (see FIG. 4A) supplied as a material to the press-molding device 30 to obtain the press-molded article 10. The preform 20 corresponds to a "first bent plate body with a hat-shaped cross section" described in the scope of claims. The preform 20 is described in detail later together with description of the "press-molding method".

<Press-Molding Device>

Figure 2:
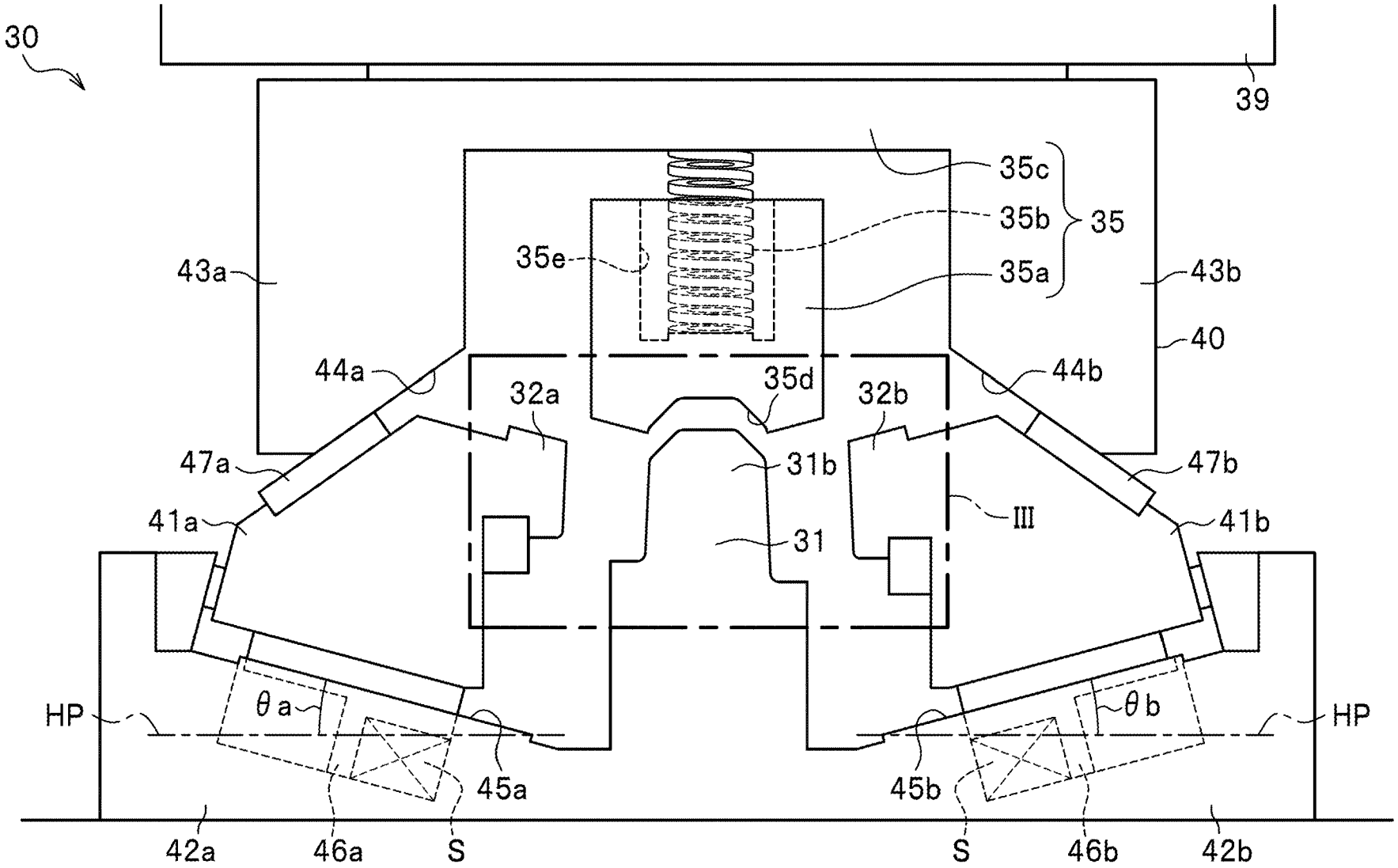
FIG. 2 is a configuration explanation diagram of a press-molding device according to the embodiment of the present invention.

FIG. 2 is a configuration explanation diagram of the press-molding device 30 according to the present embodiment. FIG. 2 schematically illustrates appearance of the press-molding device 30 from the front side.

As illustrated in FIG. 2, the press-molding device 30 is configured to mainly include a punch 31, paired dies 32*a* and 32*b*, a cam mechanism 40 that drives each of the dies 32*a* and 32*b*, and a pad 35*a* that performs holding of the later-described preform 20 (see FIG. 4A) arranged on the punch 31 and pressing of side walls 23*a* and 23*b* (see FIG. 4A).

The press-molding device 30 of the present embodiment is configured to in-plane compress the side walls 23*a* and 23*b* (see FIG. 4A) and flanges 25*a* and 25*b* (see FIG. 4A) in the preform 20 (see FIG. 4A) with the punch 31, the dies 32*a* and 32*b*, and the pad 35*a* as described in detail later.

(Punch and Dies)

The punch 31 in the present embodiment is assumed to be a fixed mold, and corresponds to a "first mold" in the scope of claims. Moreover, the dies 32*a* and 32*b* in the present embodiment are assumed to be movable molds and correspond to a "second mold" in the scope of claims. Note that the press-molding device 30 may be configured such that the dies 32*a* and 32*b* are set on the fixed side and the punch 31 is set on the movable side.

Figure 3:
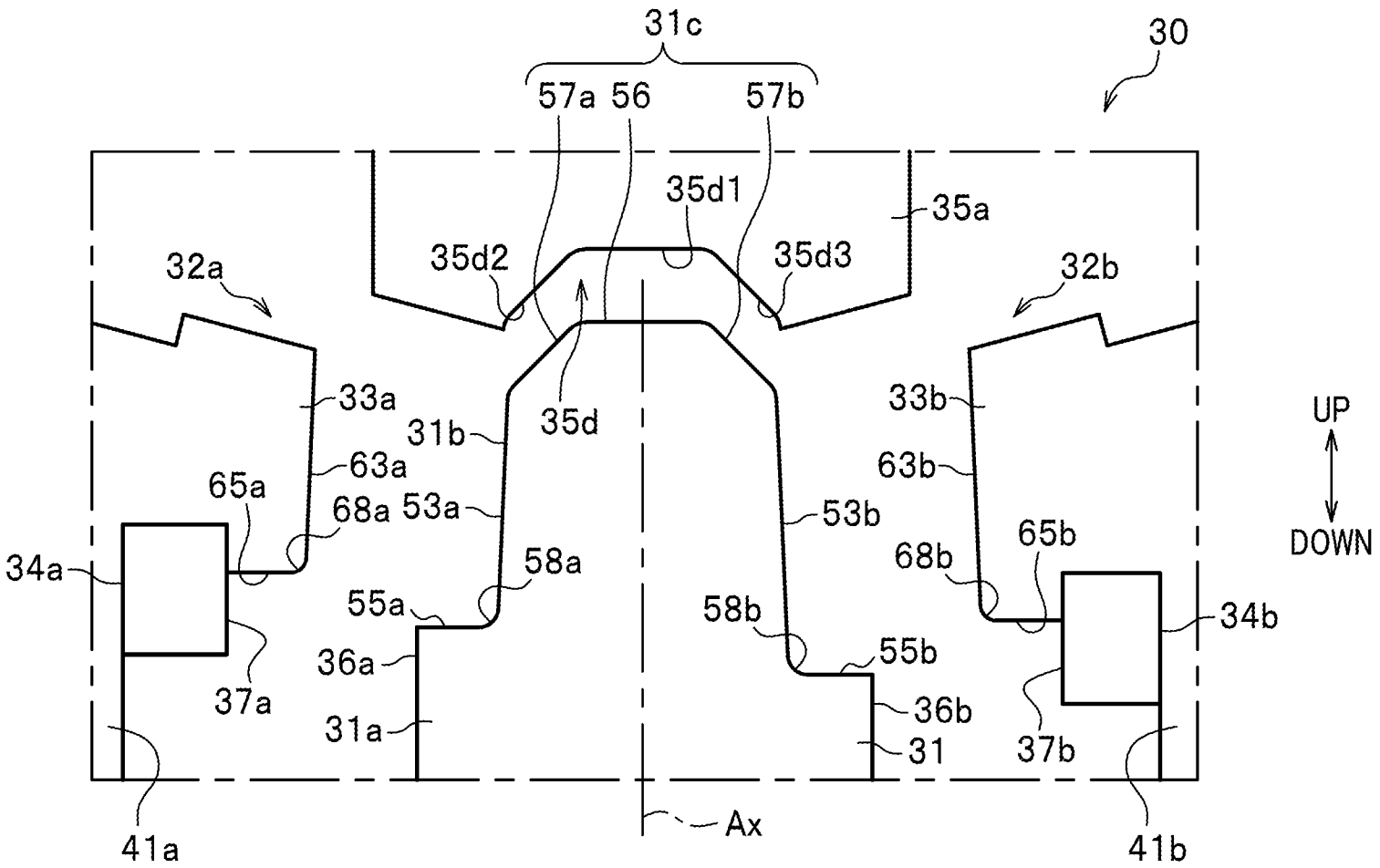
FIG. 3 is a partial enlarged view of a III portion in FIG. 2.

FIG. 3 is a partial enlarged view of a III portion in FIG. 2.

As illustrated in FIG. 3, the punch 31 in the present embodiment has a compression molding surface modeled after a recess surface 19 out of a protruding surface 18 and the recess surface 19 of the press-molded article 10 (see FIG. 1) having the hat-shaped cross section and elongated in one direction.

The punch 31 (see FIG. 3) is formed in a rail shape elongated in one direction (direction perpendicular to the sheet surface of FIG. 3) to match the press-molded article 10 (see FIG. 1).

Specifically, as illustrated in FIG. 3, the punch 31 includes a base portion 31*a* formed of a substantially-cuboid elongated body and a projecting portion 31*b* formed of a substantially-cuboid elongated body. The projecting portion 31*b* is formed to project upward at the center of the base portion 31*a* in the width direction thereof (left-right direction in the sheet surface of FIG. 3) while having a smaller width than the base portion 31*a*.

The punch 31 of the present embodiment as described above includes first wall surfaces 53*a* and 53*b* of the projecting portion 31*b* that correspond respectively to the side walls 13*a* and 13*b* (see FIG. 1) in the crown portion 11 (see FIG. 1) of the press-molded article 10 and second wall surfaces 55*a* and 55*b* of the base portion 31*a* that correspond to the flanges 15*a* and 15*b* (see FIG. 1).

The first wall surface 53*a* is continuous with the second wall surface 55*a* via a first corner portion 58*a*, and the first wall surface 53*b* is continuous with the second wall surface 55*b* via a first corner portion 58*b*.

Note that the base portion 31*a* includes an outer end surface 36*a* that intersects the second wall surface 55*a* on the opposite side to the first corner portion 58*a*. Moreover, the base portion 31*a* includes an outer end surface 36*b* that intersects the second wall surface 55*b* on the opposite side to the first corner portion 58*b*. The outer end surfaces 36*a* and 36*b* are formed to extend in the vertical direction.

Fifth wall surfaces 37*a* and 37*b* of compression blocks 34*a* and 34*b* are capable of coming into contact with the respective outer end surfaces 36*a* and 36*b* in the base portion 31*a*, at lower dead points of the dies 32*a* and 32*b* to be described later.

In the punch 31, a top portion 31*c* is formed to correspond to the top portion 14 (see FIG. 1) of the press-molded article 10 (see FIG. 1). Specifically, in the punch 31, a horizontal wall 56 is formed to correspond to the horizontal wall 16 (see FIG. 1) of the press-molded article 10 (see FIG. 1). Moreover, in the punch 31, tilted wall surfaces 57*a* and 57*b* are formed to correspond to the chamfered portions 17*a* and 17*b* (see FIG. 1) of the press-molded article 10 (see FIG. 1). Furthermore, the tilted wall surfaces 57*a* and 57*b* are continuous with the first wall surfaces 53*a* and 53*b* while forming predetermined angles therewith.

A length along the one second wall surface 55*a*, the one first corner portion 58*a*, the one first wall surface 53*a*, and the one tilted wall surface 57*a*, the horizontal wall 56, the other tilted wall surface 57*b*, the other first wall surface 53*b*, the other first corner portion 58*b*, and the second wall surface 55*b* of the punch 31 as described above, that is the peripheral length of the punch 31 is set to be equal to the peripheral length of the press-molded article 10 corresponding to the punch 31.

Next, the dies 32*a* and 32*b* are described.

As illustrated in FIG. 2, the dies 32*a* and 32*b* in the present embodiment are integral respectively with later-described cam sliders 41*a* and 41*b* of the cam mechanism 40 that can move forward and backward at predetermined angles with respect to a compression molding surface of the punch 31.

The dies 32*a* and 32*b* are arranged in a pair respectively at such positions that the projecting portion 31*b* of the punch 31 is provided at the center between the dies 32*a* and 32*b* in the horizontal direction (left-right direction in the sheet surface of FIG. 2). Specifically, the dies 32*a* and 32*b* are each formed of a long member elongated in one direction (direction perpendicular to the sheet surface of FIG. 2) to correspond to the rail-shaped punch 31.

To be more specific, in the front view illustrated in FIG. 3, the die 32*a* and the die 32*b* are arranged to be substantially line symmetric to each other with respect to a center axis Ax of the projecting portion 31*b* extending in the up-down direction. Note that the center axis Ax of the projecting portion 31*b* in the present embodiment can be defined as an axis extending in the vertical direction (coincides with the up-down direction in FIG. 3) at the center of the horizontal wall 56 in the horizontal direction (left-right direction in the sheet surface of FIG. 2).

The die 32*a* includes a die main body 33*a* and the compression block 34*a* integrally attached to the die main body 33*a*. The die 32*b* includes a die main body 33*b* and the compression block 34*b* integrally attached to the die main body 33*b*.

One die main body 33*a* arranged to correspond to the one first wall surface 53*a* in the punch 31 includes a third wall surface 63*a* parallelly facing the first wall surface 53*a*. Moreover, the other die main body 33*b* arranged to correspond to the other first wall surface 53*b* in the punch 31 includes a third wall surface 63*b* parallelly facing the first wall surface 53*b*.

Moreover, the one die main body 33*a* includes a fourth wall surface 65*a* that is parallel to the one second wall surface 55*a* of the punch 31 and that is continuous with the third wall surface 63*a* via a second corner portion 68*a*. The other die main body 33*b* includes a fourth wall surface 65*b* that is parallel to the other second wall surface 55*b* of the punch 31 and that is continuous with the third wall surface 63*b* via a second corner portion 68*b*.

The peripheral length of the die main body 33*a* from the third wall surface 63*a* to the fourth wall surface 65*a* via the second corner portion 68*a* in the one die main body 33*a* as described above is set to be equal to the peripheral length of the punch 31 from the first wall surface 53*a* to the second wall surface 55*a* via the first corner portion 58*a* in the punch 31.

Moreover, the peripheral length of the die main body 33*b* from the third wall surface 63*b* to the fourth wall surface 65*b* via the second corner portion 68*b* in the other die main body 33*b* is set to be equal to the peripheral length of the punch 31 from the first wall surface 53*b* to the second wall surface 55*b* via the first corner portion 58*b* in the punch 31.

Next, the compression blocks 34*a* and 34*b* are described.

As illustrated in FIG. 3, the compression block 34*a* is arranged to be integral with the die main body 33*a* at a base end of the die main body 33*a* located on the cam slider 41*a* side to be described later, below the die main body 33*a*. Moreover, the compression block 34*b* is arranged to be integral with the die main body 33*b*, at a base end of the die main body 33*b* located on the cam slider 41*b* side to be described later, below the die main body 33*b*.

Each of the compression blocks 34*a* and 34*b* in the present embodiment is assumed to be a block body formed of a substantially-cuboid body elongated in one direction (direction perpendicular to the sheet surface of FIG. 3) to correspond to the press-molded article 10. Note that the compression blocks 34*a* and 34*b* in the present embodiment are assumed to have a configuration in which blocks separate from the die main bodies 33*a* and 33*b* are attached to the die main bodies 33*a* and 33*b*. However, each of the compression blocks 34*a* and 34*b* may be a block integrally molded with a corresponding one of the die main bodies 33*a* and 33*b*.

In the compression block 34*a* as described above, the fifth wall surface 37*a* parallelly facing the outer end surface 36*a* of the base portion 31*a* is formed. Moreover, in the compression block 34*b*, the fifth wall surface 37*b* parallelly facing the outer end surface 36*b* of the base portion 31*a* is formed.

The fifth wall surfaces 37*a* and 37*b* of the compression blocks 34*a* and 34*b* as described above can come into contact respectively with the outer end surfaces 36*a* and 36*b* of the punch 31, at the lower dead points of the dies 32*a* and 32*b* as described later.

(Cam Mechanism)

Next, the cam mechanism 40 (see FIG. 2) is described.

As illustrated in FIG. 2, the cam mechanism 40 is configured to mainly include the paired cam sliders 41*a* and 41*b* provided to correspond respectively to the aforementioned dies 32*a* and 32*b*, paired cam bases 42*a* and 42*b* provided to correspond to these cam sliders 41*a* and 41*b*, and paired cam drivers 43*a* and 43*b* provided to correspond to the cam sliders 41*a* and 41*b*.

Note that the cam sliders 41*a* and 41*b*, the cam bases 42*a* and 42*b*, and the cam drivers 43*a* and 43*b* are formed of long members elongated in one direction (direction perpendicular to the sheet surface of FIG. 2) to correspond to the dies 32*a* and 32*b*.

The cam slider 41*a* moves the die 32*a* toward the punch 31 or moves the die 32*a* away from the punch 31 by climbing or descending a tilted surface 45*a* of the cam base 42*a* in a tilted direction.

Moreover, the cam slider 41*b* moves the die 32*b* toward the punch 31 or moves the die 32*b* away from the punch 31 by climbing or descending a tilted surface 45*b* of the cam base 42*b* in a tilted direction.

Specifically, the cam sliders 41*a* and 41*b* move the respective dies 32*a* and 32*b* toward the punch 31 at angles θa and θb each formed between the horizontal plane Hp and a corresponding one of the tilted surfaces 45*a* and 45*b* on the narrow angle side.

Note that each of the angles θa and θb may be set within a range of more than 0 degrees to less than 90 degrees (0° (deg)<θa, θb<90° (deg)), but is preferably 15 degrees or more and 60 degrees or less, particularly preferably about 15 degrees. The angles θa and θb may be the same or vary from each other. Note that the angles θa and θb in the present embodiment are both assumed to be 15 degrees.

The cam bases 42*a* and 42*b* support the respective cam sliders 41*a* and 41*b* such that the cam sliders 41*a* and 41*b* can move by sliding along the respective tilted surfaces 45*a* and 45*b*.

Note that the cam bases 42*a* and 42*b* in the present embodiment are integrally formed. A center portion where the cam bases 42*a* and 42*b* are connected to one another also serves as a supporting portion of the punch 31.

Furthermore, the cam bases 42*a* and 42*b*, respectively, include biasers 46*a* and 46*b* using coil springs or the like that bias the respective cam sliders 41*a* and 41*b* in directions away from the punch 31. Note that these biasers 46*a* and 46*b* are not limited to particular means and may be, for example, a well-known structure in which springs S are arranged between the cam base 42*a* and the cam slider 41*a* and between the cam base 42*b* and the cam slider 41*b*. Examples of the springs S include gas springs, coil springs, and the like.

A plurality of the biasers 46*a* or 46*b* as described above are assumed to be arranged along the longitudinal direction (direction perpendicular to the sheet surface of FIG. 2) of each of the cam bases 42*a* and 42*b*.

The cam drivers 43*a* and 43*b* in the present embodiment, together with a pad unit 35 including the pad 35*a* to be described later, form a substantially E-shape open on the lower side in the front view of the press-molding device 30 illustrated in FIG. 2. Specifically, the cam drivers 43*a* and 43*b* are each connected to a pad support portion 35*c* that extends in the horizontal direction below a lifting-lowering mechanism 39 to be described later and that can move up and down.

To be more specific, upper end portions of the respective cam drivers 43*a* and 43*b* are connected to the pad support portion 35*c* such that the pad unit 35 is arranged at the center between the cam drivers 43*a* and 43*b*. The cam drivers 43*a* and 43*b* extend downward from the pad support portion 35*c* and form cam surfaces 44*a* and 44*b* that drive the cam sliders 41*a* and 41*b*.

The cam surfaces 44*a* and 44*b* are formed on lower end surfaces of the cam drivers 43*a* and 43*b* facing the cam sliders 41*a* and 41*b*.

Each of the cam surfaces 44*a* and 44*b* is configured to be a tilted surface whose position gradually becomes lower while extending away from the pad 35*a* arranged at the center between the cam surfaces 44*a* and 44*b*.

Slide members 47*a* and 47*b* that guide the cam sliders 41*a* and 41*b* along the cam surfaces 44*a* and 44*b* by sliding relative to the cam surfaces 44*a* and 44*b* are attached to upper surfaces of the respective cam sliders 41*a* and 41*b*.

These cam drivers 43*a* and 43*b* move the respective cam sliders 41*a* and 41*b* toward the punch 31 via the cam surfaces 44*a* and 44*b* when the lifting-lowering mechanism 39 including, for example, a hydraulic cylinder or the like moves the pad support portion 35*c* downward. Specifically, the cam surfaces 44*a* and 44*b* thrust the respective cam sliders 41*a* and 41*b* toward the punch 31 at the aforementioned angles θa and θb against biasing force of the biasers 46*a* and 46*b*.

Conversely, when the lifting-lowering mechanism 39 moves the pad support portion 35*c* upward, the pressing force (thrusting force) of the cam surfaces 44*a* and 44*b* on the cam sliders 41*a* and 41*b* is released. The cam sliders 41*a* and 41*b* are thereby restored to original positions by the biasing force of the biasers 46*a* and 46*b*.

(Pad)

Next, the pad 35*a* (see FIG. 2) is described.

The pad 35*a* in the present embodiment is configured of a substantially-cuboid block elongated in one direction (direction perpendicular to the sheet surface of FIG. 2) to correspond to the press-molded article 10 (see FIG. 1).

As illustrated in FIG. 2, the pad 35*a* is attached to the pad support portion 35*c* via a later-described cushion member 35*b*, to be located above the punch 31.

As illustrated in FIG. 3, the pad 35*a* includes a groove portion 35*d* into which the top portion 31*c* of the punch 31 fits, in a lower end portion facing the punch 31. The groove portion 35*d* is formed to extend in one direction (direction perpendicular to the sheet surface of FIG. 3) to correspond to the press-molded article 10 (see FIG. 1).

Specifically, the groove portion 35*d* includes a bottom surface 35*d*1 formed to correspond to the horizontal wall 16 (see FIG. 1) of the press-molded article 10 (see FIG. 1) and side surfaces 35*d*2 and 35*d*3 formed to correspond to the chamfered portions 17*a* and 17*b* (see FIG. 1) of the press-molded article 10 (see FIG. 1).

Although the cushion member 35*b* (see FIG. 2) in the present embodiment is assumed to be a coil spring, another spring such as a gas spring may also be used as the cushion member 35*b*.

As illustrated in FIG. 2, the cushion member 35*b* in the present embodiment is housed above the groove portion 35*d*, in a cylindrical space 35*e* formed to extend in the up-down direction of the pad 35*a*. The lower end of the cushion member 35*b* is attached to a spring seat (illustration is omitted) provided in a bottom portion of the cylindrical space 35*e*, and the upper end of the cushion member 35*b* is attached to the pad support portion 35*c*.

Note that a plurality of the cushion members 35*b* as described above are arranged in the longitudinal direction (direction perpendicular to the sheet surface of FIG. 3) of the pad 35*a*.

Figure 4A:
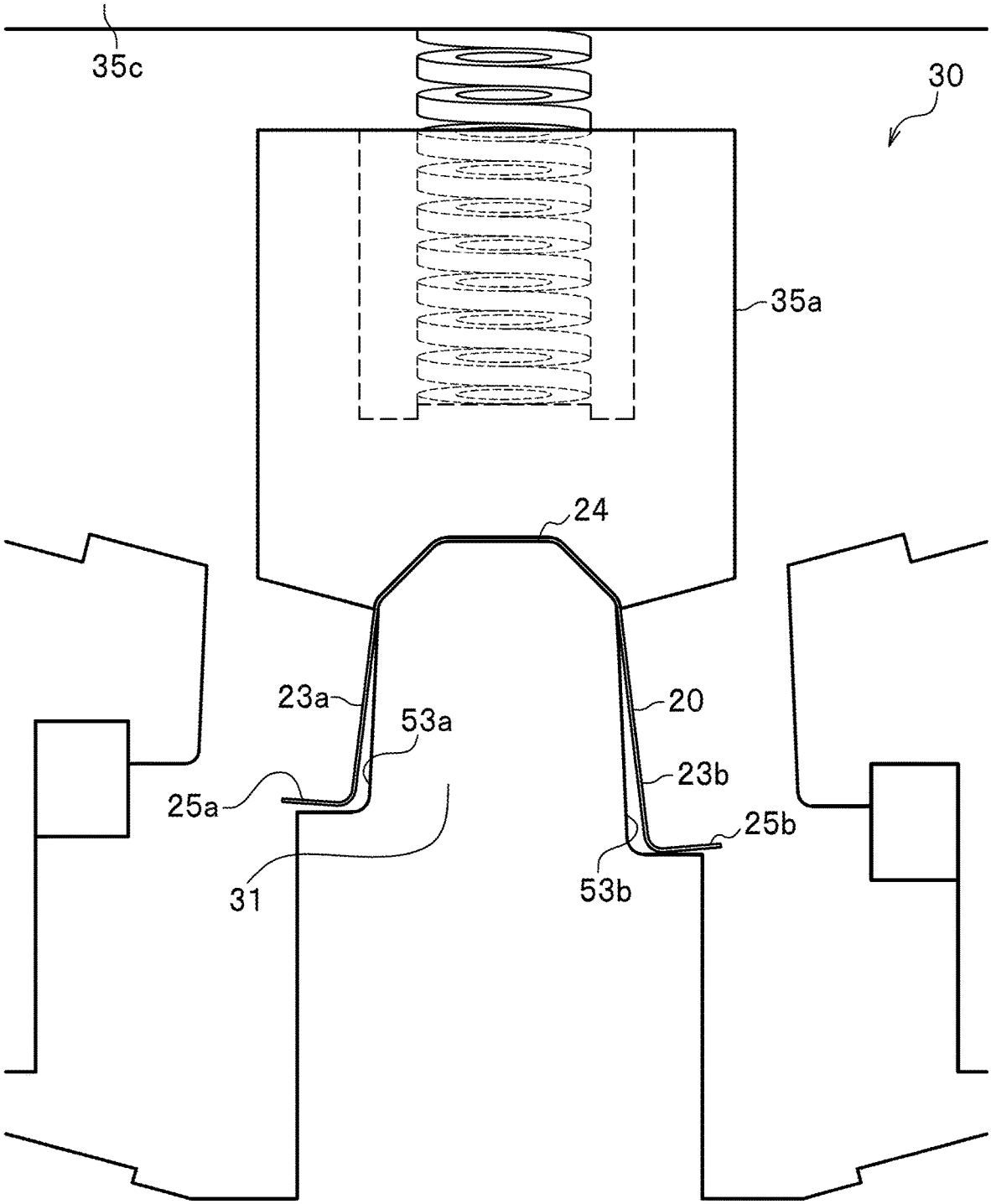
FIG. 4A is a diagram explaining a step in the method for manufacturing the press-molded article according to the embodiment of the present invention, and is a diagram illustrating a step of arranging a preform (first bent plate body with a hat-shaped cross section) that is a compression material, on a punch.
Figure 4B:
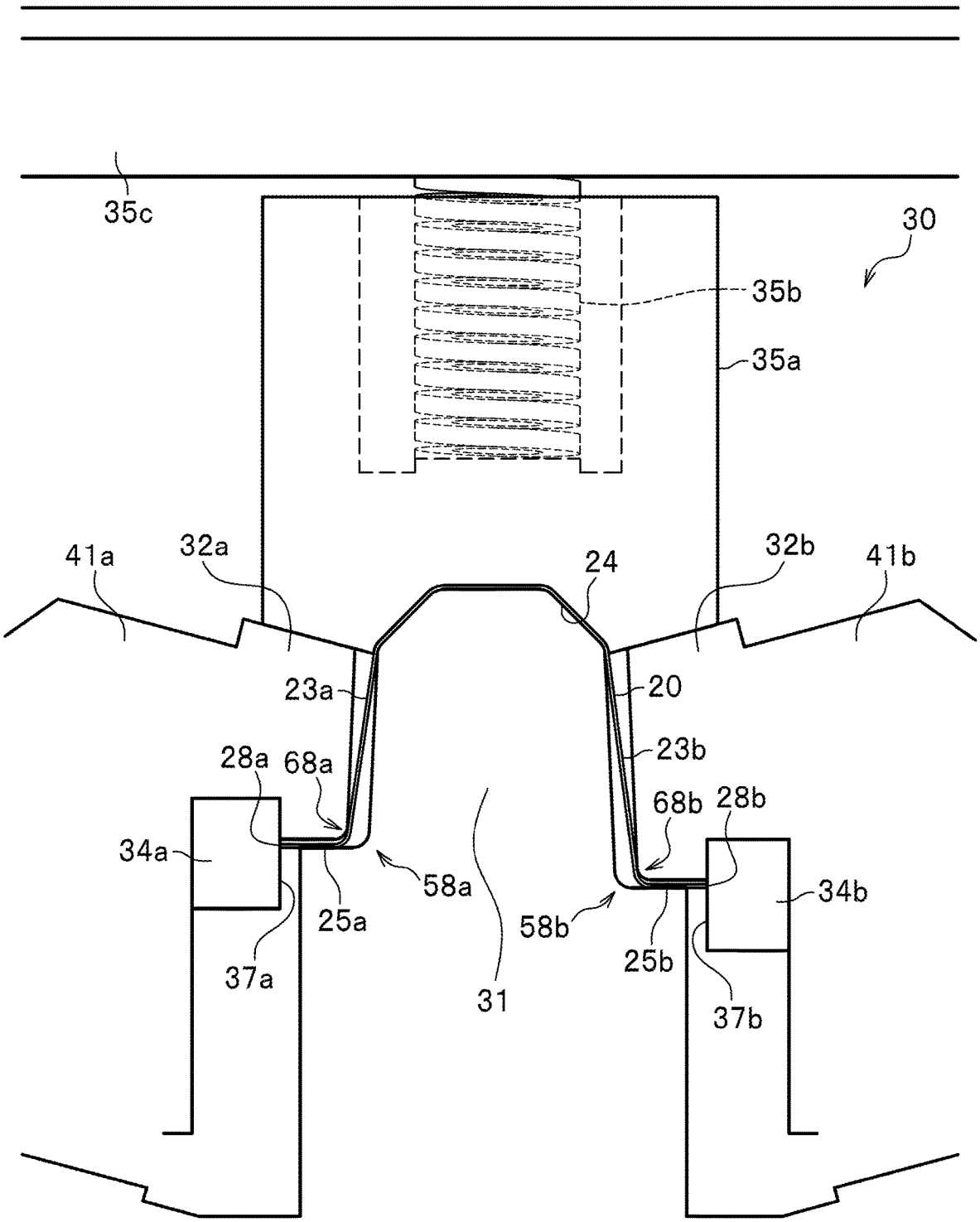
FIG. 4B is a diagram explaining a step in the method for manufacturing the press-molded article according to the embodiment of the present invention, and is a diagram illustrating a step of pressing end portions of sprung-back flanges in the preform (first bent plate body with the hat-shaped cross section) that is the compression material, in a plane direction.
Figure 4C:
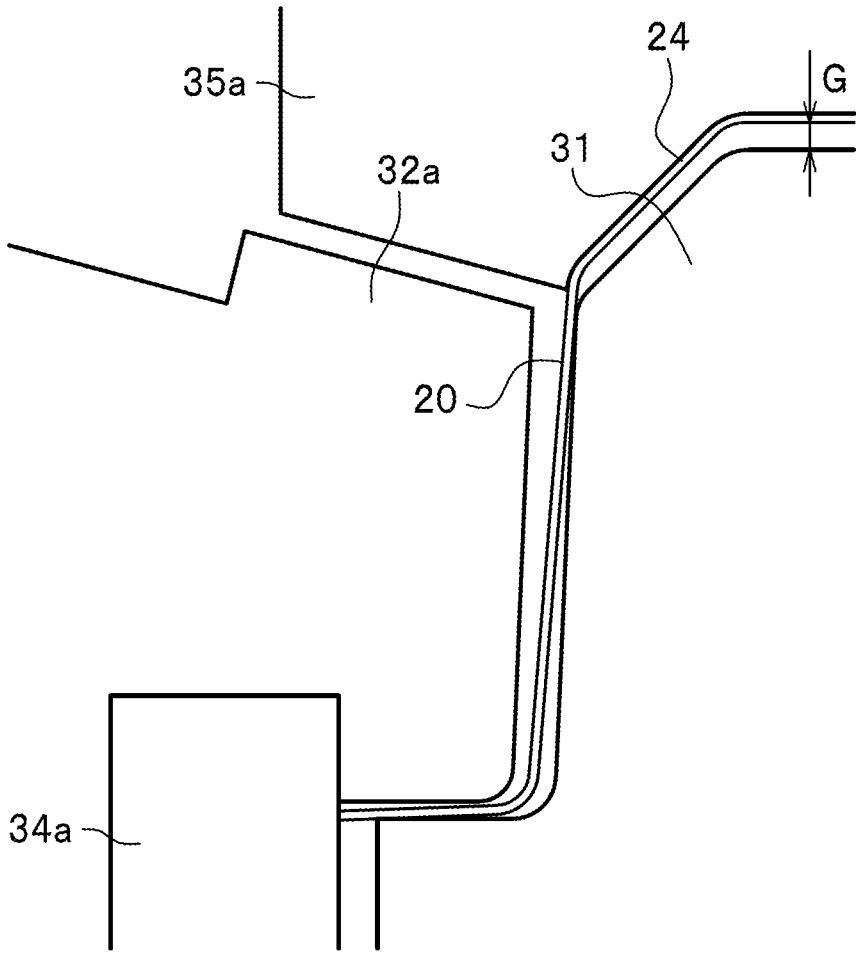
FIG. 4C is a diagram explaining a step in the method for manufacturing the press-molded article according to the embodiment of the present invention, and is a diagram explaining a step of compressing side walls of the preform (first bent plate body with the hat-shaped cross section).

The spring constant of the cushion member 35*b* is adjusted such that the cushion member 35*b* has room to contract until the pad 35*a* transitions from a state where the pad 35*a* is out of contact with the punch 31 as illustrated in FIG. 2 to a state where the pad 35*a* (see FIG. 4C) starts compression molding on a top portion 24 (see FIG. 4C) of the preform 20 (see FIG. 4C). Moreover, the cushion member 35*b* cannot contract until the pad 35*a* transitions from the state (see FIG. 4C) where the pad 35*a* starts the compression molding on the top portion 24 (see FIG. 4C) to at least a state (see FIG. 4E) where the pad 35*a* reaches the lower dead point thereof. Furthermore, the spring constant of the cushion member 35*b* is adjusted such that the pad 35*a* can hold the top portion 24 (see FIG. 4A) of the preform 20 (see FIG. 4A) from the state illustrated in FIG. 2 to the state illustrated in FIG. 4C.

<Press-Molding Method>

Next, the press-molding method according to the present embodiment executed by the press-molding device 30 (see FIG. 2) according to the present embodiment is described while giving description of operations of the press-molding device 30.

FIGS. 4A to 4E are diagrams explaining steps of the press-molding method.

Figure 4D:
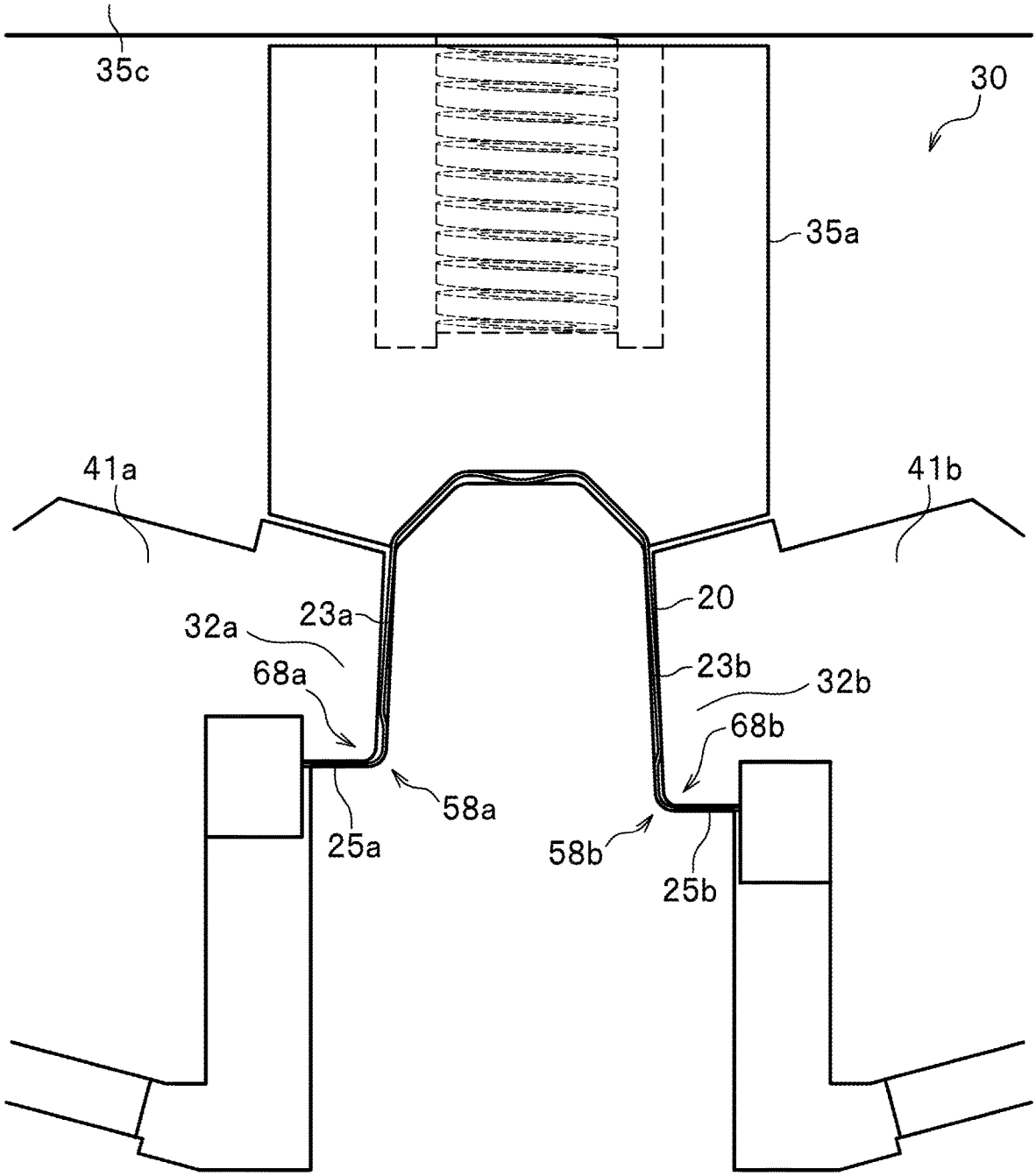
FIG. 4D is a diagram explaining a step in the method for manufacturing the press-molded article according to the embodiment of the present invention, and is a diagram illustrating how the side walls of the preform (first bent plate body with the hat-shaped cross section) are in-plane compressed.
Figure 4E:
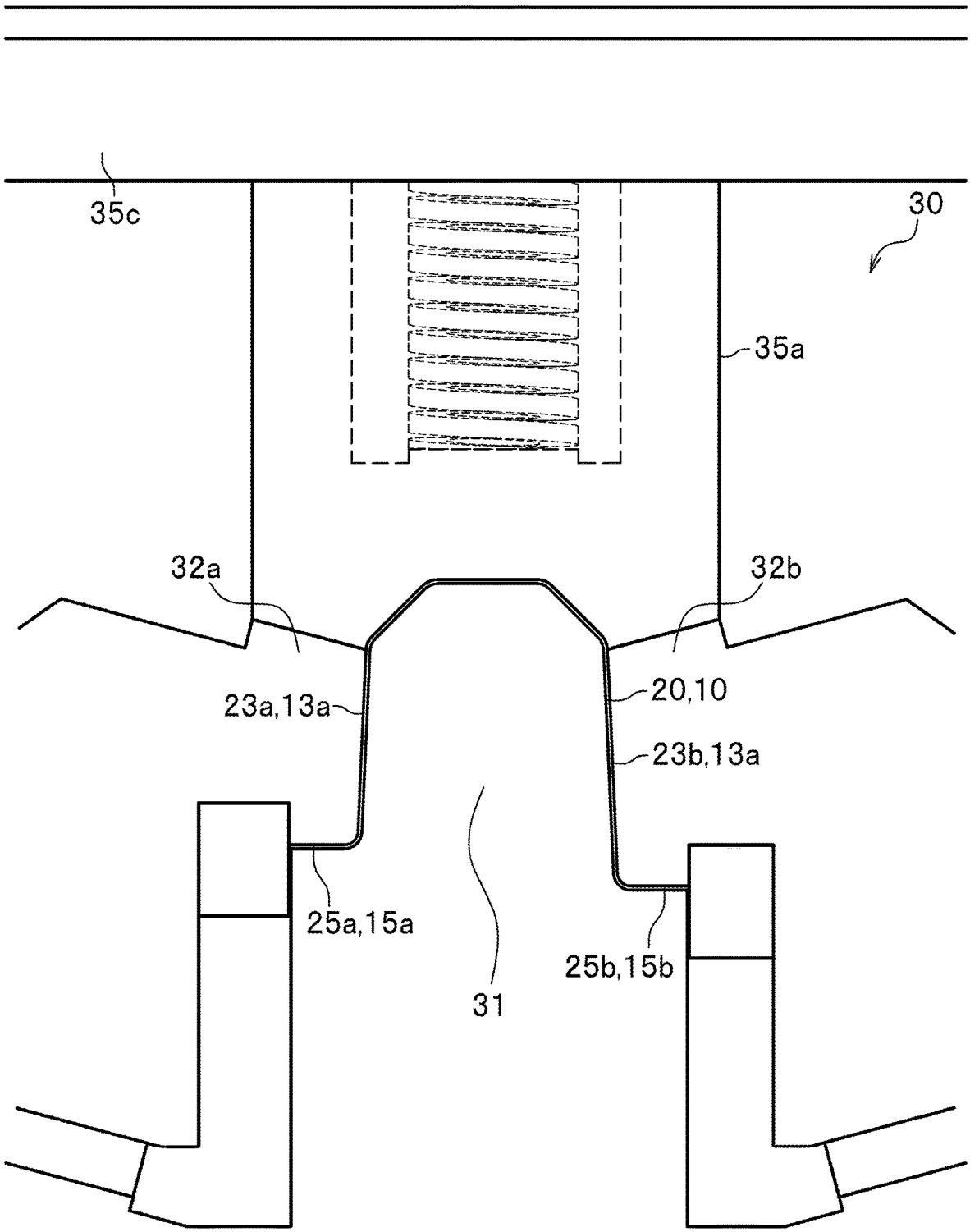
FIG. 4E is a diagram explaining a step in the method for manufacturing the press-molded article according to the embodiment of the present invention, and is a diagram illustrating how the press-molded article (second bent plate body with a hat-shaped cross section) is obtained in the mold.

FIG. 4A is a diagram illustrating a step (first step) of arranging the preform 20 (first bent plate body with the hat-shaped cross section) on the punch 31. FIG. 4B is a diagram illustrating a step (second step) of pressing end portions of the sprung-back flanges 25*a* and 25*b* in the preform 20 (first bent plate body with the hat-shaped cross section) in in-plane directions of the flanges 25*a* and 25*b*. FIG. 4C is a diagram explaining a step (third step) of compressing the side walls 23*a* and 23*b* of the preform (first bent plate body with the hat-shaped cross section). FIG. 4D is a diagram illustrating how the side walls 23*a* and 23*b* of the preform 20 (first bent plate body with the hat-shaped cross section) are in-plane compressed. FIG. 4E is a diagram illustrating how the press-molded article 10 (second bent plate body with the hat-shaped cross section) is obtained in the mold (punch 31, dies 32*a* and 32*b*).

(First Step)

As illustrated in FIG. 4A, in the first step of the press-molding method in the present embodiment, the preform 20 is arranged on the punch 31.

The preform 20 (first bent plate body with the hat-shaped cross section) corresponds to the "first bent plate body with the hat-shaped cross section" described in the scope of claims as described above.

Note that FIG. 4A illustrates a state where the top portion 24 of the preform 20 is held at the pad 35*a* by lowering the lifting-lowering mechanism 39 after arranging the preform 20 on the punch 31 in the state where the pad 35*a* and the punch 31 are out of contact with each other as illustrated in FIG. 2.

The preform 20 that is the material for obtaining the press-molded article 10 (see FIG. 1) can be manufactured by supplying a blank of, for example, a high-tensile strength steel plate to, for example, a press-molding device including a die (illustration is omitted) that has a compression molding surface modeled after the protruding surface 18 (see FIG. 1) side of the press-molded article 10 and a punch (illustration is omitted) that has a compression molding surface modeled after the recess surface 19 (see FIG. 1) side of the press-molded article 10.

In the preform 20 as described above, so-called spring back occurs mainly due to stress generated in bent portions of the blank.

Specifically, as illustrated in FIG. 4A, when the top portion 24 is held on the upper portion of the punch 31 at the pad 35*a*, the preform 20 is in a state where the side walls 23*a* and 23*b* of the preform 20 are lifted from the first wall surfaces 53*a* and 53*b* of the punch 31, respectively.

Note that, in the first step of the present embodiment, there is prepared the preform 20 in which the side walls 23*a* and 23*b* are longer than the side walls 13*a* and 13*b* (see FIG. 1) of the press-molded article 10 (see FIG. 1), respectively, as illustrated in FIG. 4A. Meanwhile, the lengths of the flanges 25*a* and 25*b* of the preform 20 are about the same as the lengths of the flanges 15*a* and 15*b* (see FIG. 1) of the press-molded article 10 (see FIG. 1), respectively.

Note that the preform 20 is not limited to the aforementioned design, and the lengths of the flanges 25*a* and 25*b* may be changed as described later as another embodiment of the present invention.

(Second Step)

Next, the second step of the press-molding method in the present embodiment is described.

In the second step, as illustrated in FIG. 4B, the compression blocks 34*a* and 34*b* press outer end portions 28*a* and 28*b* of the sprung-back flanges 25*a* and 25*b*.

In the second step, first, when the lifting-lowering mechanism 39 (see FIG. 2) moves the pad support portion 35*c* (see FIG. 2) downward from the state where the position of the pad 35*a* is that illustrated in FIG. 4A, the pad 35*a* comes into contact with the top portion 24 of the preform as illustrated in FIG. 4B. In this case, as illustrated in FIG. 4B, the cushion member 35*b* presses the top portion 24 of the preform 20 more strongly via the pad 35*a* while shrinking.

Meanwhile, the downward moving of the pad support portion 35*c* (see FIG. 2) by the lifting-lowering mechanism 39 (see FIG. 2) causes the cam drivers 43*a* and 43*b* illustrated in FIG. 2 to move the respective cam sliders 41*a* and 41*b* toward the punch 31.

The dies 32*a* and 32*b* provided in the cam sliders 41*a* and 41*b* thereby come close to the punch 31 as illustrated in FIG. 4B.

Specifically, the second corner portions 68*a* and 68*b* of the dies 32*a* and 32*b* move to come close to the first corner portions 58*a* and 58*b* of the punch 31.

Then, the fifth wall surfaces 37*a* and 37*b* of the compression blocks 34*a* and 34*b* press the outer end portions 28*a* and 28*b* of the flanges 25*a* and 25*b* in the preform 20 toward the first corner portions 58*a* and 58*b* of the punch 31, respectively.

Note that the dies 32*a* and 32*b* (compression blocks 34*a* and 34*b*) that press the flanges 25*a* and 25*b*, the cam mechanism 40, and the lifting-lowering mechanism 39 form a "first pressing mechanism" described in the scope of claims.

(Third Step)

Next, the third step of compressing the side walls 23*a* and 23*b* of the preform 20 (first bent plate body with the hat-shaped cross section) is described.

In the third step, as illustrated in FIG. 4C, a gap G is formed between the punch 31 and the top portion 24 of the preform 20.

The compression blocks 34*a* and 34*b* further press the outer end portions 28*a* and 28*b* of the flanges 25*a* and 25*b*, respectively, from the positions of the compression blocks 34*a* and 34*b* illustrated in FIG. 4B, and the gap G is thereby formed.

Specifically, as illustrated in FIG. 4C, the top portion 24 of the preform 20 lifts the pad 35*a* upward with the gap G formed as an escape margin of an excessive portion of the preform 20 squeezed into a space between the die 32*a* (illustration of the die 32*b* is omitted) and the punch 31 at the compression block 34*a* (illustration of the compression block 34*b* is omitted).

Then, when the lifting-lowering mechanism 39 (see FIG. 2) moves the pad support portion 35*c* downward from the state where the position of the pad 35*a* is that illustrated in FIG. 4C, the cushion member 35*b* that cannot contract causes the pad 35*a* to press the top portion 24 of the preform downward. Upper end portions 29*a* and 29*b* of the side walls 23*a* and 23*b* are thereby pressed toward the first corner portions 58 of the punch 31.

The pad 35*a* that presses the upper end portions 29*a* and 29*b* of the side walls 23*a* and 23*b* as described above and the lifting-lowering mechanism 39 (see FIG. 2) form a "second pressing mechanism" described in the scope of claims.

In the third step, in the cam drivers 43*a* and 43*b* (see FIG. 2), the lifting-lowering mechanism 39 (see FIG. 2) moves the pad support portion 35*c* (see FIG. 2) downward. As illustrated in FIG. 4D, the second corner portions 68*a* and 68*b* in the dies 32*a* and 32*b* provided in the cam sliders 41*a* and 41*b* thereby move to come close to the first corner portions 58*a* and 58*b* of the punch 31. The side walls 23*a* and 23*b* and the flanges 25*a* and 25*b* of the preform 20 (first bent plate body with the hat-shaped cross section) are thereby compressed between the punch 31 and the dies 32*a* and 32*b*.

The press-molding method of the present embodiment is configured such that the third step of compressing the side walls 23*a* and 23*b* and the flanges 25*a* and 25*b* of the preform 20 between the punch 31 and the dies 32*a* and 32*b* illustrated in FIG. 4D is performed in parallel with the second step of pressing the outer end portions 28*a* and 28*b* of the flanges 25*a* and 25*b* of the preform 20 toward the first corner portions 58 of the punch 31 illustrated in FIG. 4B.

Specifically, as illustrated in FIG. 4D, the preform 20 (first bent plate body with the hat-shaped cross section) with a larger peripheral length than the peripheral length of the punch 31 is squeezed on the punch 31 such that an excessive length is resolved according to the peripheral length of the punch 31.

The flanges 25*a* and 25*b* and the side walls 23*a* and 23*b* of the preform 20 are thereby in-plane compressed in the peripheral length direction of the hat shape of the preform 20.

Then, as illustrated in FIG. 4E, the in-plane compressed flanges 25*a* and 25*b* and the side walls 23*a* and 23*b* form the flanges 15*a* and 15*b* and the side walls 13*a* and 13*b*, respectively, and the press-molded article 10 is formed in the mold formed of the punch 31, the dies 32*a* and 32*b*, and the pad 35*a*.

<<Operational Effects>>

Next, operational effects provided by the press-molding method and the press-molding device 30 of the present embodiment are described.

In the press-molding method of the present embodiment, the press-molded article 10 (second bent plate body with the hat-shaped cross section) is obtained by in-plane compressing the side walls 23*a* and 23*b* and the flanges 25*a* and 25*b* of the preform 20 (first bent plate body with the hat-shaped cross section) along the peripheral length direction of the hat shape.

According to the press-molding method as described above, when the side walls 23*a* and 23*b* and the flanges 25*a* and 25*b* are in-plane compressed along the peripheral length direction of the hat shape, stress generated in the bent portions in the hat shape is canceled out. The press-molding method in the present embodiment can thereby eliminate spring back generated in the preform 20 in a simple step such a compression molding process, unlike in a conventional press-molding method (for example, see Patent Literature 1) in a conventional deep drawing process.

The press-molded article 10 obtained by this press-molding method has excellent dimensional accuracy due to reduction of the spring back.

Moreover, in the press-molding method of the present embodiment, the third step of compressing the side walls 23*a* and 23*b* and the flanges 25*a* and 25*b* of the preform 20 between the punch 31 and the dies 32 is performed in parallel with the second step of pressing the outer end portions 28*a* and 28*b* of the flanges 25*a* and 25*b* of the preform 20 toward the first corner portions 58 of the punch 31.

In the press-molding method as described above, the in-plane compression can be performed on the side walls 23*a* and 23*b* and the flanges 25*a* and 25*b* of the preform 20 (first bent plate body with the hat-shaped cross section) in a simpler step.

The press-molding device 30 of the present embodiment includes a compression mechanism that includes the dies 32*a* and 32*b* and the punch 31 configured to compress the side walls 23*a* and 23*b* and the flanges 25*a* and 25*b* of the preform 20, a first pressing mechanism that presses the outer end portions 28*a* and 28*b* of the flanges 25*a* and 25*b*, and the second pressing mechanism that presses the upper end portions 29*a* and 29*b* of the side walls 23*a* and 23*b*.

According to the press-molding device 30 as described above, it is possible to obtain the aforementioned operational effects of the press-molding method and execute the aforementioned press-molding method in a simple configuration.

In the press-molding device 30 of the present embodiment, the first pressing mechanism and the second pressing mechanism are interlocked with each other via the cam mechanism 40.

According to the press-molding device 30 as described above, when the compression step of the flanges 25*a* and 25*b* and the side walls 23*a* and 23*b* is executed, control of the step of pressing the outer end portions 28*a* and 28*b* of the flanges 25*a* and 25*b* and the step of pressing the upper end portions 29*a* and 29*b* of the side walls 23*a* and 23*b* that are performed together with the compression step is simplified. The in-plane compression of the flanges 25*a* and 25*b* and the side walls 23*a* and 23*b* can be thereby more accurately executed.

In the press-molding device 30 of the present embodiment, the first pressing mechanism includes the fifth wall surfaces 37*a* and 37*b* that come close to the outer end surfaces 36*a* and 36*b* of the punch 31 as the second corner portions 68*a* and 68*b* of the dies 32*a* and 32*b* and the first corner portions 58*a* and 58*b* of the punch 31 relatively come close to one another. Specifically, the fifth wall surfaces 37*a* and 37*b* of the compression blocks 34*a* and 34*b* forming the first pressing mechanism form the dies 32*a* and 32*b* together with the die main bodies 33*a* and 33*b*.

According to the press-molding device 30 as described above, it is possible to interlock the compression mechanism formed of the dies 32*a* and 32*b* and the punch 31 with the first pressing mechanism that presses the outer end portions 28*a* and 28*b* of the flanges 25*a* and 25*b*.

This can simplify the configurations of the compression mechanism and the first pressing mechanism, and achieve size reduction of the press-molding device 30.

In the press-molding device 30 of the present embodiment, the aforementioned second pressing mechanism is the pad 35*a* that presses the top portion 31*c* of the preform 20 when the second corner portions 68*a* and 68*b* of the dies 32*a* and 32*b* and the first corner portions 58*a* and 58*b* of the punch 31 relatively come close to one another.

According to the press-molding device 30 as described above, it is possible to interlock the compression mechanism formed of the dies 32*a* and 32*b* and the punch 31 and the second pressing mechanism formed of the pad 35*a* with each other.

This can simplify the configurations of the compression mechanism and the second pressing mechanism, and achieve size reduction of the press-molding device 30.

Although the embodiment of the present invention has been described above, the present invention is not limited to the aforementioned embodiment, and various changes can be made within a scope not departing from the gist of the present invention.

Figure 5A:
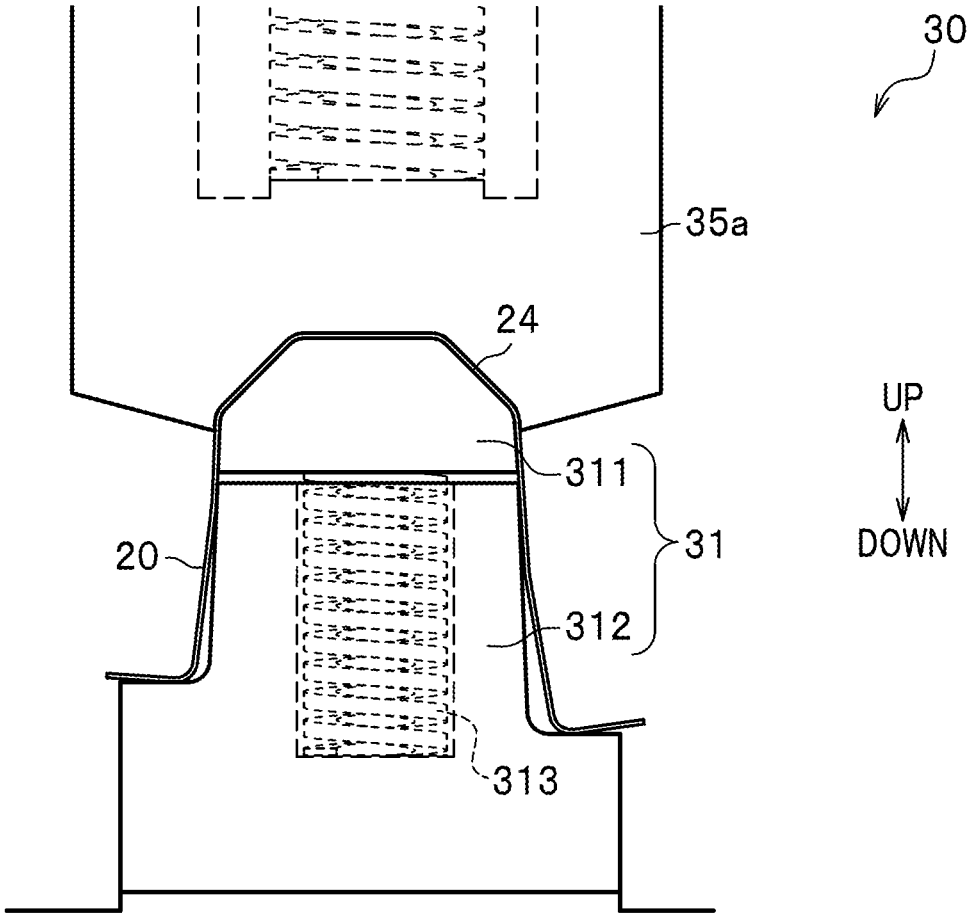
FIG. 5A is a diagram explaining a configuration of a modified example of the press-molding device in the present invention.
Figure 5B:
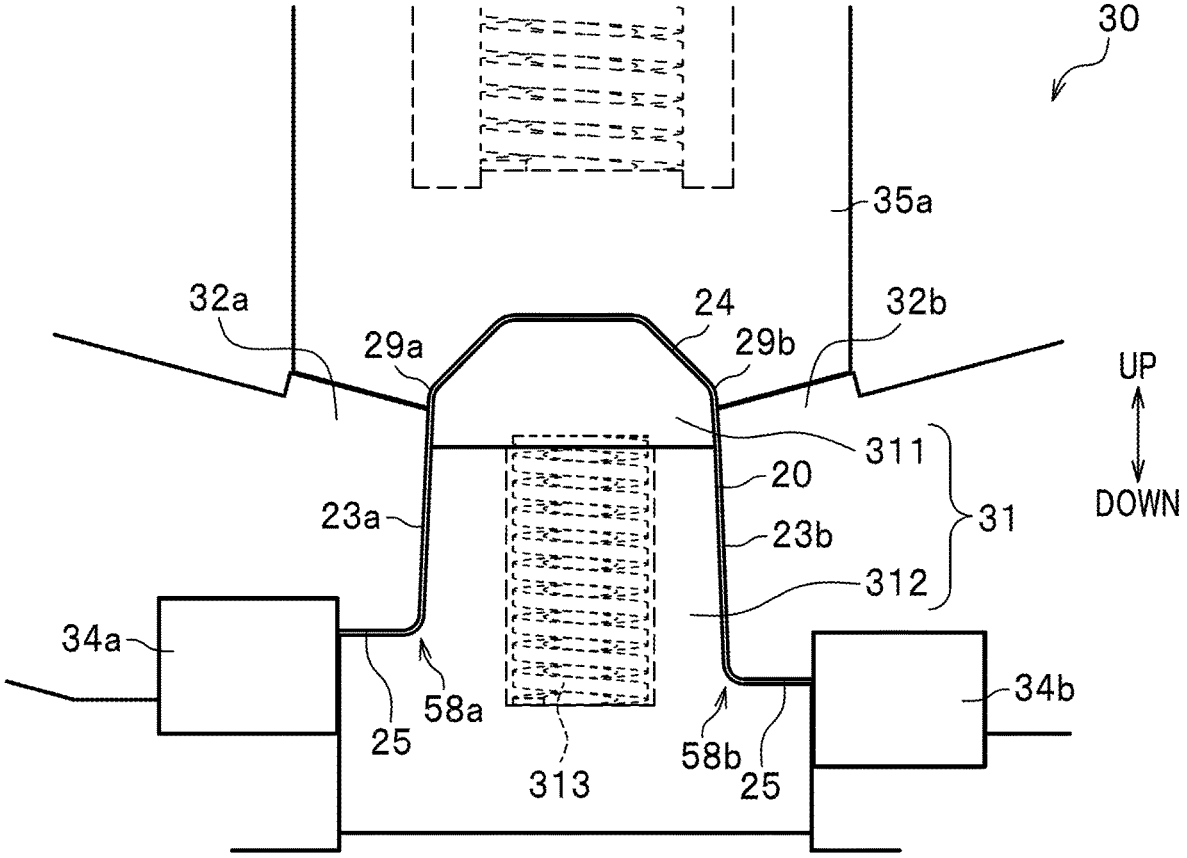
FIG. 5B is a diagram explaining an operation of the press-molding device according to the modified example of FIG. 5A.

FIG. 5A is a diagram explaining a configuration of a first modified example of the press-molding device 30. FIG. 5B is a diagram explaining an operation of the press-molding device 30 according to the first modified example of FIG. 5A.

As illustrated in FIG. 5A, in the press-molding device 30 according to the first modified example, the punch 31 is divided into two parts of an upper punch 311 and a lower punch 312.

A lifter 313 is arranged between the upper punch 311 and the lower punch 312. Note that the lifter 313 is formed of a cushion member such as, for example, a coil spring.

The lifter 313 is configured to lift the upper punch 311 by using biasing force such that a predetermined gap is opened upward when the first step illustrated in FIG. 4A is performed, the upper punch 311 holding the top portion 24 of the preform 20 between itself and the pad 35*a*.

Then, in the press-molding device 30 according to the first modified example, when the pad 35*a* presses down the top portion 24 of the preform 20 against the biasing force of the lifter 313 as illustrated in FIG. 5B, the gap between the upper punch 311 and the lower punch 312 disappears.

The pad 35*a* thereby presses the upper end portions 29*a* and 29*b* of the side walls 23*a* and 23*b* toward the first corner portions 58*a* and 58*b* of the punch 31 when the side walls 23*a* and 23*b* and the flanges 25*a* and 25*b* are compressed between the punch 31 and the dies 32*a* and 32*b*.

According to the press-molding device 30 in the first modified example as described above, the press-down amount of the upper end portions 29*a* and 29*b* by the pad 35*a* can be defined by using the gap between the upper punch 311 and the lower punch 312. Accordingly, it is possible to set the press-down amount to a fixed amount.

Note that reference signs 34*a* and 34*b* in FIG. 5B denote the compression blocks.

Although the first wall surfaces 53*a* and 53*b* of the punch 31 in the press-molding device 30 (see FIG. 3) of the aforementioned embodiment are tilted such that a distance between the first wall surfaces 53*a* and 53*b* gradually becomes smaller toward the upper side, tilting of the first wall surfaces 53*a* and 53*b* relative to each other is not limited to particular tilting.

Specifically, in the press-molding device 30, the compression blocks 34*a* and 34*b* are arranged on the dies 32*a* and 32*b* sides. Accordingly, the first wall surfaces 53*a* and 53*b* may be parallel to each other in the front view of the press-molding device 30 illustrated in FIG. 3, or form an undercut in an opposite manner to the first wall surfaces 53*a* and 53*b* illustrated in FIG. 3.

Note that the first wall surfaces 53*a* and 53*b* forming the undercut can be subjected to prospect molding.

Moreover, although illustration is omitted, accuracy assurance of a press-molded article that has a vertical wall or a wall close to vertical needs to depend on a mold with an undercut shape, but this processing is impossible in the existing press-molding device. Meanwhile, in the press-molding device 30 of the present embodiment, the combination of the cam mechanism 40 and the compression blocks 34*a* and 34*b* enables a configuration using a mold with an undercut shape as described above.

Furthermore, in the press-molding method of the embodiment, the preform in which the side walls 23*a* and 23*b* are longer than the side walls 13*a* and 13*b* of the press-molded article 10 is prepared as the preform 20. However, the preform 20 is not limited to this.

Specifically, in the press-molding method of the present invention, it is only necessary that the preform 20 with a larger peripheral length than the peripheral length of the punch 31 is arranged on the punch 31 when the second step is performed in parallel with the third step as described above. Accordingly, although the lengths of the flanges 25*a* and 25*b* of the preform 20 are to be set to about the same lengths as the flanges 15*a* and 15*b* of the press-molded article 10 in principle as described above, the lengths of the flanges 25*a* and 25*b* may be larger or smaller than the lengths of the flanges 15*a* and 15*b* of the press-molded article 10 (see FIG. 1) to some extent, on the premise that the preform 20 has a longer peripheral length than the peripheral length of the punch 31.

EXPLANATION OF REFERENCE NUMERALS

10 press-molded article
11 crown portion
12 brim portion
13*a* side wall
13*b* side wall
14 top portion
15*a*, 15*b* flange
16 horizontal wall
18 protruding surface
19 recess surface
20 preform
23*a*, 23*b* side wall
24 top portion
25*a*, 25*b* flange
28*a*, 28*b* outer end portion
29*a*, 29*b* upper end portion
30 press-molding device
31 punch
31*a* base portion
31*b* projecting portion
31*c* top portion
32 die
32*a* die
32*b* die
33*a* die main body
33*b* die main body
34 compression block
34*a* compression block
34*b* compression block
35 pad unit
35*a* pad
35*b* cushion member
35*c* pad support portion
35*d* groove portion
35*e* cylindrical space
36*a* outer end surface
36*b* outer end surface
37 fifth wall surface
37*a* fifth wall surface
37*b* fifth wall surface
39 lifting-lowering mechanism
40 cam mechanism
41*a* cam slider
41*b* cam slider
42*a* cam base
42*b* cam base
43*a*, 43*b* cam driver
44*a*, 44*b* cam surface
45*a* tilted surface
45*b* tilted surface
46*a* biaser
47*a* slide member
53*a* first wall surface
53*b* first wall surface
55*a* second wall surface
55*b* second wall surface
56 horizontal wall
57*a* tilted wall surface
57*b* tilted wall surface
58 first corner portion
58*a* first corner portion
58*b* first corner portion
63*a* third wall surface
63*b* third wall surface
65*a* fourth wall surface
65*b* fourth wall surface
68*a* second corner portion
68*b* second corner portion
35*d*1 bottom surface
35*d*2 side surface
Ax center axis
G gap
Hp horizontal plane
S spring

The invention claimed is:

1. A method for manufacturing a second bent plate body with a hat-shape by in-plane compressing a first bent plate body with a hat-shape between a first mold and a second mold, over a range from a side wall forming a crown portion of the hat shape in the first bent plate body to a flange of the hat shape, along a peripheral length direction of the hat shape, wherein the first mold is formed of a stationary punch which comprises: a first wall surface formed to correspond to a side wall of the second bent plate body; and a second wall surface formed to correspond to a flange of the second bent plate body, the first wall surface and the second wall surface are continuous with each other to form a first corner, the second mold is formed of a die which comprises: a third wall surface in parallel to the first wall surface; and a fourth wall surface parallel to the second wall surface, the third wall surface and the fourth wall surface are continuous with each other to form a second corner portion, the method comprising:

a first step of disposing the side wall of the first bent plate body between the first wall surface and the third wall surface and disposing the flange of the first bent plate body between the second wall surface and the fourth wall surface;

a second step of pressing an end of the flange on the opposite side to the first corner portion of the flange in the first bent plate body toward the first corner portion by moving the die to the stationary punch; and a third step of compressing the side wall of the first bent plate body between the first wall surface and the third wall surface and the flange of the first bent plate body between the second wall surface and the fourth wall surface while the first corner portion and the second corner portion relatively come close to each other by moving the fie to the stationary punch, and the second step is performed in parallel with the third step.

2. The method for manufacturing the second bent plate body as set forth in claim 1, wherein the stationary punch includes an outer end surface intersecting the second wall surface on the opposite side to the first corner portion, and the method further comprising:

pressing a fifth wall surface of the die against the outer end surface of the stationary punch as the first corner portion and the second corner portion relatively come close to each other.

3. The method for the second bent plate body as set forth in claim 1, further comprising:

pressing an end portion of the side wall on the opposite side to the first corner portion in the first bent plate body against a top portion of the stationary punch by a pad while the pad moves toward the first corner portion.

4. A press-molding device comprising a first mold and a second mold, wherein the press-molding device is configured to obtain a second bent plate body with a hat-shaped cross section by in-plane compressing a first bent plate body with a hat-shaped cross section between the first mold and the second mold, each of bent plate bodies comprising:

a side wall formed to correspond to a crown portion of a hat-shape and extending in a height direction of the crown portion; and a flange formed to correspond to a brim portion of the hat-shape and extending outward from an end portion of the side wall on an open side of the crown portion to project in a direction away from the end portion, the first mold is formed of a stationary punch which comprises:

a first wall surface formed to correspond to a side wall of the second bent plate body; and a second wall surface formed to correspond to a flange of the second bent plate body, the first wall surface and the second wall surface are continuous with each other to form a first corner portion, the second mold is formed of a movable die which comprises:

a third wall surface parallel to the first wall surface; and a fourth wall surface parallel to the second wall surface, the third wall surface and the fourth wall surface are continuous with each other to form a second corner portion, the press-molding device further comprising:

a compression mechanism of the stationary punch and movable die configured to bring the first corner portion and the second corner portion close to each other and compress a side wall and a flange of the first bent plate body between the first wall surface and the third wall surface and between the second wall surface and the fourth wall surface;

a first pressing mechanism of the movable die configured to move toward the first corner portion to press an end portion of the flange on the opposite side to the first corner portion in the first bent plate body toward the first corner portion; and a second pressing mechanism including a movable pad configured to move toward the first corner portion to press an end portion of the side wall on the opposite side to the first corner portion in the first bent plate body against a top portion of the stationary punch.

5. The press-molding device as set forth in claim 4, wherein the first pressing mechanism and the second pressing mechanism are interlocked with each other via a cam mechanism.

6. The press-molding device as set forth in claim 5, wherein the cam mechanism intervenes between the first pressing mechanism and the second pressing mechanism, and while the second pressing mechanism moves vertically toward the stationary punch, the second pressing mechanism moves the first pressing mechanism horizontally toward the stationary punch using the cam mechanism.

7. The press-molding device as set forth in claim 4, wherein the stationary punch includes an outer end surface intersecting the second wall surface on the opposite side to the first corner portion, wherein the movable die includes a fifth wall surface to come close to the outer end surface of the stationary punch as the first corner portion and the second corner portion relatively come close to each other.

8. The press-molding device as set forth in claim 4, wherein the movable pad is disposed to correspond to a top portion of a hat-shape of each of the bent plate bodies and is configured to press the top portion of the hat-shape against a top portion of the stationary punch while the first corner portion and the second corner portion relatively come close to each other.

* * * * *